United States Patent [19]

Vetter

[11] 4,201,368

[45] May 6, 1980

[54] ARRANGEMENT FOR EMERGENCY OPENING A VEHICLE DOOR

[76] Inventor: Manfred Vetter, Zülpich-Langendorf, Fed. Rep. of Germany

[21] Appl. No.: 959,362

[22] Filed: Nov. 9, 1978

[30] Foreign Application Priority Data

Nov. 16, 1977 [DE] Fed. Rep. of Germany ... 7735079[U]

[51] Int. Cl.[2] ..... B66F 3/00

[52] U.S. Cl. ..... 254/131

[58] Field of Search ..... 254/131, 133; 269/171, 269/171.5

[56] References Cited

U.S. PATENT DOCUMENTS

| | | | |
|---|---|---|---|
| 176,752 | 5/1876 | Marsh | 269/171 |
| 2,018,902 | 10/1935 | Schwedland | 254/131 |
| 3,091,983 | 6/1963 | Kliss | 254/131 |

FOREIGN PATENT DOCUMENTS

| | | | |
|---|---|---|---|
| 872495 | 6/1942 | France | 269/171 |

*Primary Examiner*—Robert C. Watson

*Attorney, Agent, or Firm*—Michael J. Striker

[57] ABSTRACT

An arrangement for emergency opening of a vehicle door has an inner elongated member adapted to abut against an inner face of the vehicle door, a transverse elongated member adapted to extend through a door window opening, and an outer elongated member adapted to be located outside of the vehicle door and to exert a force on the latter so as to open the door or break it open. The inner member is of one piece with the transverse member. The outer member is movably connected with the transverse member and is movable lengthwise of the latter and relative to the inner member, whereby the distance between the inner and outer members can be varied.

17 Claims, 4 Drawing Figures

FIG. 1
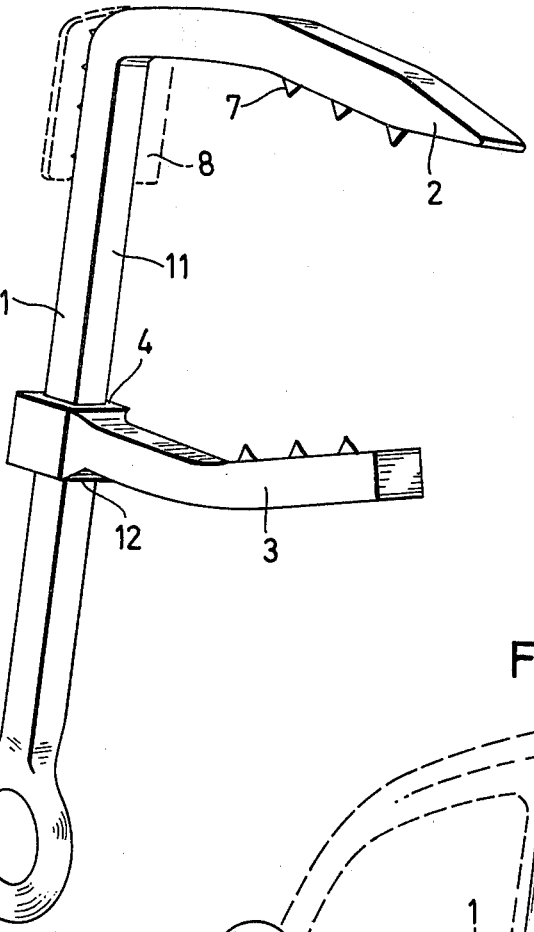
FIG. 2
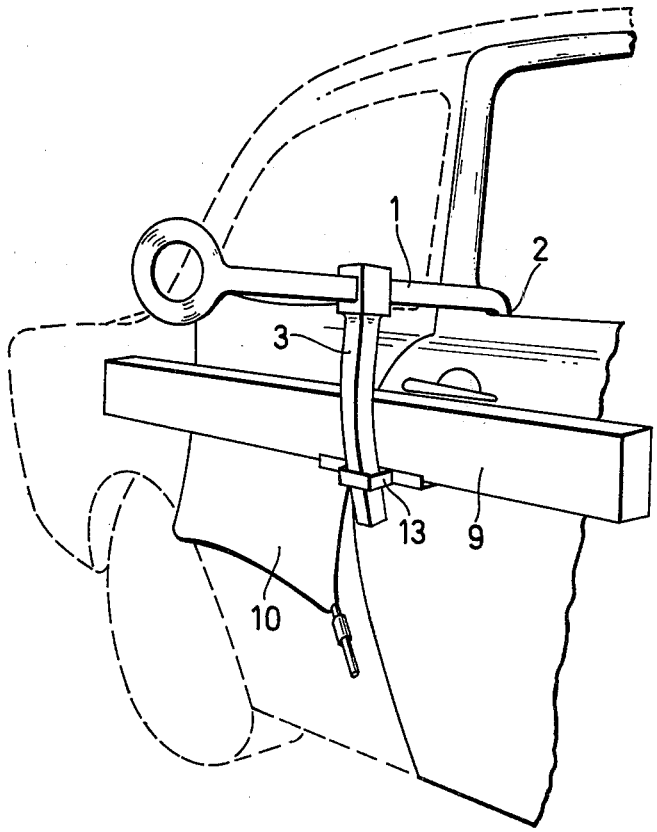
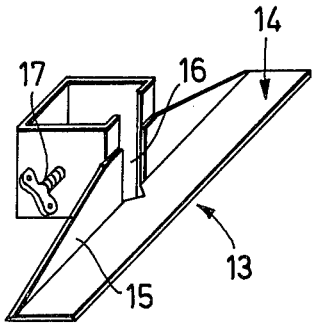
FIG. 3

ARRANGEMENT FOR EMERGENCY OPENING A VEHICLE DOOR

BACKGROUND OF THE INVENTION

The present invention relates to an arrangement for emergency opening, and more particularly for breaking up a vehicle door.

Known arrangements for opening or breaking open vehicle doors are utilized in case of an emergency, for instance in case of accidents when it is necessary to break open closed or jammed vehicle doors. When the arrangement is utilized for a passenger car, a beam is placed on the outer face and lengthwise of the vehicle adjacent to the lower edge of the vehicle window. One end portion of the beam lies on the outer face of the vehicle door to be broken up and extends as close as possible to the vehicle door hinges. The other end portion extends outwardly beyond the edge of the vehicle door, which is to be disengaged from the vehicle body. A U-shaped pulling element of the arrangement is then placed so that its outer leg lies on the beam adjacent to the door handle. An inner leg of the pulling element abuts against an inner face of the vehicle door, whereas a transverse portion or cross piece of the pulling element, which connects the inner and the outer legs with each other, extends through the door window opening. An inflatable cushion is then inserted between the other end portion of the beam and the vehicle body. When the cushion is inflated, it urges the beam outwardly from the vehicle body so as to tear off the door.

The above described pulling element is made as an integral member. It is composed of a quandrangular bar which is bent so as to assume a U-shaped configuration. A pulling rod is arranged on the free end of the outer leg of the pulling element, the pulling rod extending outwardly and terminating by a ring. Practical applications of such an arrangement have shown that it possesses a disadvantage which is based on the fact that various vehicles have doors of different thicknesses. In order to set the U-shaped pulling element onto the vehicle doors having differing thicknesses several beams are provided also having differing thicknesses. When the arrangement is utilized for breaking up a vehicle door having a particular thickness, it is necessary to select a beam having a respective thickness. However, the arrangement is generally utilized in emergency situations, that means that in most cases it must operate as fast as possible in order to release passengers which are trapped in the vehicle. It is to be understood that the above mentioned neccessity to accurately select a respective beam is a considerable disadvantage of the arrangement.

SUMMARY OF THE INVENTION

Accordingly, it is an object of the present invention to provide an arrangement for emergency opening a vehicle door, which avoids the disadvantages of the prior art.

More particularly, it is an object of the present invention to provide an arrangement for opening a vehicle door, which can be simply and rapidly adjusted to different thicknesses of beams and doors and provide for optimum utilization of the working displacement of an inflatable cushion.

In keeping with these objects and with others which will become apparent hereinafter one feature of the present invention resides, briefly stated, in an arrangement for emergency opening a vehicle door, having an inner member adapted to abut against an inner face of the vehicle door, an outer member located outside of the vehicle door, and a transverse member connecting the inner and outer members with one another, wherein the outer member is connected movably to the transverse member so that the former can move lengthwise of the latter and relative to the inner member, whereby a distance between the inner and outer members can be varied.

When the outer member is movable relative to the inner member so as to vary the distance therebetween, the arrangement can be easily and rapidly adjusted to different thicknesses of beams and doors, and provides optimum utilization of the working displacement of an inflatable cushion interposed between the beam and the vehicle body.

Another feature of the present invention is that one of the end portions of the outer member, located adjacent to the transverse member may be provided with a passage through which the transverse member can movably extend. In such a construction the walls of the outer member which bound the passage, serve as guding means for movement of the outer member lengthwise of the transverse member. Preferably, the transverse dimensions of the passage of the outer member correspond to those of the transverse member, whereas the length of the passage corresponds to each of the transverse dimensions of the transverse member.

Still another feature of the present invention is that limiting means may be provided on the transverse member, and more particularly on its portion which is spaced from the inner member in the direction of elongation of the transverse member. This means serves for limiting the movement of the outer member in the direction away from the inner member, and at the same time may perform the functions of a handle to be grasped by a user. The above mentioned means may be formed as a ring-shaped portion of the transverse member.

A further feature of the present invention is that faces of the inner and outer members, which face toward one another may be provided with engaging formations. These formations may be formed as thorn-like projections.

Still a further feature of the present invention is that a bumper member may be mounted on the end portion of the transverse member, the end portion being located adjacent to the inner member. The bumper member may extend laterally outwardly beyond side faces of the transverse member, peferably by a distance equal to substantially 3 cm.

An additional feature of the present invention is that at least one face of the transverse member, extending normal to the inner and outer members may be provided with saw-toothed engaging projections which are engageable with at least a portion of one wall bounding the passage of the outer member. The saw-toothed projections may have shorter flanks facing toward the inner member, and edges extending transversely to the direction of elongation of the transverse member.

Finally, still an additional feature of the present invention is that supporting means may be provided for supporting a beam which is to be interposed between the outer member of the arrangement and the vehicle body. The supporting means may include a supporting member which is movable lengthwise of the outer member and fixable in each of a plurality of its locations.

The novel features which are condisered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a perspective view showing an arrangement for emergency opening a vehicle door, in accordance with the present invention;

FIG. 2 is a perspective view showing a lower side portion of a passenger car with the inventive arrangement which is set on the latter;

FIG. 3 is a view showing a supporting member of the invention arrangement, destined for supporting a beam to be interposed between a part of the arrangement and a vehicle body.

DESCRIPTION OF A PREFERRED EMBODIMENT

Figure 4:
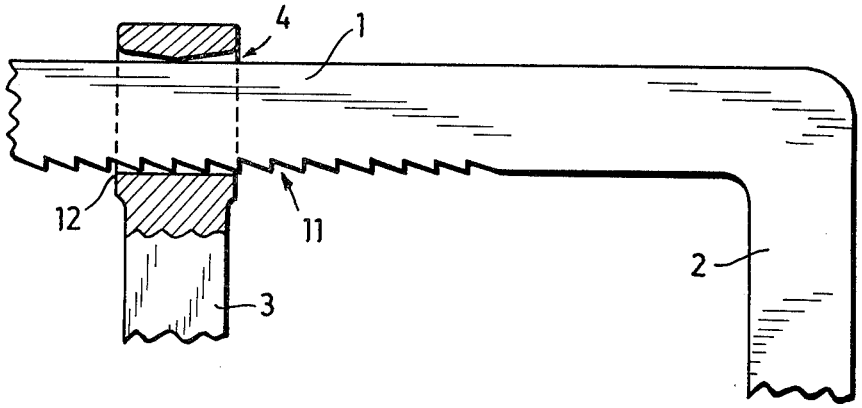
FIG. 4 is an enlarged view of a structured face of a transverse member of the arrangement.

An arrangement for emergency opening or breaking up a vehicle door is depicted in FIG. 1 and includes an L-shaped metal rod. A longer portion of the rod forms a transverse member 1, and a shorter portion of the rod forms an inner member 2 of the same. The members land 2 extend substantrally normal to each other. An outer member 3 is arranged parallel to the inner member 1 in spaced relationship with the latter and is movable lengthwise of the transverse member 1.

In order to provide this movement, an end portion of the outer member 3 which is located adjacent to the transverse member 1 is thickened so as to form a head, and a passage 4 is provided which pierces through this head. The transverse dimensions of the passage 4 of the outer member 3 are somewhat greater than the transverse dimensions of the transverse member 1. The length of the passage 4 substantially corresponds to each of the transverse dimensions of the transverse member 1.

The transverse member 1 extends through the passage 4 of the outer member 3, and the latter can move lengthwise of the former and relative to the inner member 2 so as to vary a distance between the inner and outer members.

The members 2 and 3 have substantially equal lengths. These members are bent approximately in their central regions by an angle equal to approximately 25° so that their free end sections are inclined toward each other.

A ring 6 is arranged on a free end portion 5 of the transverse member 2, which portion is opposite to the inner member 2. The ring 6 may be welded to the transverse member 1. It limits the displacement of the outer member 3 lengthwise of the transverse member 1, whereby the outer member cannot be removed from the transverse member. The inner diameter of the ring 6 is so selected that a user can insert his or her hand into the ring 6 in order to grasp the latter.

The members 2 and 3 have inner faces which face toward one another and are provided with engaging formations. These engaging formations are formed as three thorn-like projections 7 arranged on each of these faces. The tips of the projections 7 arranged on the members 2 and 3 face toward each other. The projections 7 prevent sliding off of the members 2 and 3 from respective surfaces during practical application of the arrangement.

Due to the play between the walls bounding the passage 4 of the outer member 3 and the faces of the transverse member 1, as well as due to the predetermined length of the passage 4, the transverse member 1 can be jammed in the outer member 3 under the action of a load which is applied parallel to the transverse member 1. The inner member 2 is preferably formed as a beam having uniform strength. A bumper member 8, shown in dotted lines in FIG. 1, is provided in the region of transition from the transverse member 1 to the inner member 2. The bumper member 8 extends in the direction of elongation of the transverse member 1 by a distance equal to substantially 12 mm from the inner end of the transverse member 1. The bumper member 8 also overlaps the transverse member 1 in the direction transverse to the direction of elongation thereof and extends laterally outwardly beyond each of the side faces of the transverse member by several centimeters, for instance by 3 cm. In the embodiment shown in FIG. 1 the bumper member 8 is formed as a plate which is welded to an upper face of the transverse member 1. The bumper member 8 guarantees a certain distance between the arrangement and a vertical edge of the window opening. Thereby, the danger is eliminated that the free end portion of the inner member 2 will abut not against the inner face of the car door to be removed, but against an inner face of a part of the car located adjacent to the door.

The face 11 of the transverse member 1 is preferably structured, as shown in FIG. 4. For instance, it may be provided with a saw-toothed formations whose edges extend transverse to the direction of elongation of the transverse member 1, and whose shorter flanks face toward the inner member 2. Thereby, the outer member 3 is reliably held on the transverse member 1 even in unfavorable conditions, inasmuch as an outer edge 12 of the wall bounding the passage 4, which outer edge lies on the face 11, abuts against the shorter flanks. In such a case play-free connection between the edge 12 of the outer member and the transverse member 1 is attained. Preferably, in this case the other edges of the walls bounding the passage 4 are rounded so that the outer member 3 is easily dispaceable lengthwise of the transverse member 1.

The transverse member 1 and the inner member 2 together form an integral member having a cross section which preferably is shaped as a narrow rectangle. The sides of the rectangle which extend parallel to the inner member 2 and the outer member 2 are longer than the other sides. The integral member forming the transverse member 1 and the inner member 2 may be manufactured, for instance by forging.

The outer member 3 is provided with means 13 for supporting a beam 9, the means including a supporting plate 14 which is formed as an L-shaped profile element 15, as shown in FIG. 2. The profile element 15 has a slot 16 so as to permit the former to be pulled over the thorn-shaped projections 7 of the outer member 3. A clamping screw 17 is provided for fixing the L-shaped profile element 15 at a respective location on the outer member 3. The functions of this screw may also be performed by an arresting arrangement including a flat spring with a gripping portion and an arresting tooth. Such as arresting arrangement may be connected with the supporting means 13 and cooperate with arresting recesses provided on the outer member 3.

FIG. 2 shows practical application of the inventive arrangement. The beam 9 is placed on the outer face of the car body parallel and adjacent to the lower edge of the car window. One end portion of the beam 9 is located adjacent to the door hinges, but in the region of the door. The other end portion of the beam 9 extends over the car door and laterally outwardly beyond its edge which is to be released. An inflatable cushion 10 is placed near the other end of the beam and opposite to the car door at a location between the beam 9 and the car body. The displaceable outer member 3 is placed on the beam 9 in the region of the door handle. The transverse member 1 extends through the window opening, and the inner member 2, fixedly connected with the transverse member, abuts against the inner face of the car door in the region of the door lock. Before inflating of the cushion 10, the outer member 3 is urged toward to the inner member 2 to provide the smallest possible distance between these members. In this case, when the inflation of the cushion 19 starts a leverage is immediately applied to the arrangement and thereupon the car door is broken up.

It will be understood that each of the elements described above, or two or more together, may also find a useful application in other types of constructions differing from the types described above.

While the invention has been illustrated and described as embodied in an arrangement for emergency opening a vehicle door, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for emergency opening of a vehicle door, comprising an elongated inner member arranged for abutting against an inner surface of a vehicle door; an elongated transverse member extending transverse to said inner member and arranged to extend through a window opening of the vehicle door, said transverse member being of one piece with and extending substantially normal to said inner member; an elongated outer member extending outside of the vehicle door substantially parallel to said inner member in spaced relationship with the latter and arranged for applying a force to the vehicle door for opening the latter, said transverse member extending through said outer member and the latter being movable lengthwise of said transverse member relative to the inner member so as to vary the distance between said outer and inner members whereby the vehicle door can be forcedly opened, said inner and outer members having inner faces facing toward one another and provided with thorn-like projections which prevent sliding off of the arrangement from the vehicle door, said outer member being arranged so that a beam can be located between said outer member and an outer face of of the vehicle door; and means for supporting the beam and arranged on said outer member.

2. An arrangement as defined in claim 1; and further comprising guiding means for guiding said outer member during its movement.

3. An arrangement as defined in claim 2, said outer member has two end portions spaced from one another in the direction of elongation thereof, one of said end portions being located adjacent to said transverse member, said guiding means including a passage formed in said one end portion of said outer member through which said transverse member extends.

4. An arrangement as defined in claim 3, wherein said transverse member has a cross section of predetermined transverse dimensions, said passage of said outer member having transverse dimensions substantially corresponding to the transverse dimensions of said cross section of said transverse member with play therebetween.

5. An arrangement as defined in claim 3, wherein said transverse member has two transverse dimensions, said passage having a length substantially corresponding to each of said transverse dimensions of said transverse member.

6. An arrangement as defined in claim 1, wherein said transverse member has two ends portions spaced from one another in the direction of elongation thereof, one of said end portions being located adjacent to said inner member, whereas the other end portion is spaced from the latter; and further comprising means for limiting movement of said outer member lengthwise of said transverse member in the direction away from said inner number, said limiting means being formed on said other end portion of said transverse member.

7. An arrangement as defined in claim 6, wherein said limiting means includes a projection against which said outer member abuts.

8. An arrangement as defined in claim 4, wherein said outer member has walls bounding said passage, said transverse member having two faces extending in the direction of elongation thereof and substantially normal to said inner and outer members, one of said faces being provided with saw-toothed engaging projections which are releasably engageable with at least a portion of one of said walls of said outer member, so that said outer member can easily and fast move over said transverse member as a result of provision of play on the one hand, and can be reliably arrested as a result of engagement of said saw-toothed projections of said transverse member with said outer member, on the other hand.

9. An arrangement as defined in claim 8, wherein said one wall of said outer member has an outer edge facing away from said inner member, said engaging formations being releasably engageable with said outer edge.

10. An arrangement as defined in claim 9, wherein each of said formations has a shorter flank and a longer flank, the shorter flanks of said engaging formations facing toward said inner member.

11. An arrangement as defined in claim 8, wherein said engaging projections have edges extending in a direction which is substantially transverse to the direction of elongation of said transverse member.

12. An arrangement as defined in claim 1, wherein said supporting means includes a supporting member which is displaceable in the direction of elongation of said outer member.

13. An arrangement as defined in claim 1, wherein said supporting member is displaceable between a plurality of locations spaced from one another in the direction of elongation of said outer member and is arrestable at each of said locations; and further comprising means for arresting said supporting member at each of said locations.

14. An arrangement as defined in claim 1, particularly associable with a beam to be located between said outer member and an outer face of the vehicle door, the thorn-like projections provided on said inner member engaging the inner surface of the vehicle door, and the thorn-like projections provided on said outer member engaging the beam.

15. An arrangement for emergency opening of a vehicle door, comprising an elongated inner member arranged for abutting against an inner surface of a vehicle door; an elongated transverse member extending transverse to said inner member and arranged to extend through a window opening of the vehicle door, said transverse member being fixedly connected with said inner member, said transverse member having two end portions spaced from one another in the direction of elongation thereof, one of said end portions being located adjacent to said inner member, whereas the other end portion is spaced from the latter; an elongated outer member extending outside of the vehicle door substantially parallel to said inner member in spaced relationship with the latter and arranged for applying a force to the vehicle door for opening the latter, said outer member being movably connected with said transverse member and movable lengthwise of said transverse member relative to the inner member so as to vary the distance between said outer and inner members; and means for limiting movement of said outer member lengthwise of said transverse member in the direction away from said inner member, said limiting means being provided on said other end portion of said transverse member and formed as a handle arranged to be grasped by a user.

16. An arrangement as defined in claim 15, wherein said projection is a ring-shaped portion of said transverse member.

17. An arrangement for emergency opening of a vehicle door, comprising an elongated inner member arranged for abutting against an inner surface of a vehicle door; an elongated transverse member extending transverse to said inner member and arranged to extend through a window opening of the vehicle door, said transverse member being of one piece with and extending substantially normal to said inner member; an elongated outer member extending outside of the vehicle door substantially parallel to said inner member in spaced relationship with the latter and arranged for applying a force to the vehicle door for opening the latter, said transverse member extending through said outer member and the latter being movable lengthwise of said transverse member relative to the inner member so as to vary the distance between said outer and inner members whereby the vehicle door can be forcedly opened, said inner and outer members having inner faces facing toward one another and provided with thorn-like projections which prevent sliding off the arrangement from the vehicle door, said transverse member having two side faces; and a bumper member arranged on said transverse member adjacent to said inner member and extending outwardly laterally beyond each of side faces of said transverse member in the direction transverse to the direction of elongation of the latter by a distance equal to at least 3 cm, so that said inner member cannot extend laterally outwardly beyond the vehicle door.

* * * * *